United States Patent [19]

Lachenal et al.

[11] Patent Number: 4,756,798

[45] Date of Patent: Jul. 12, 1988

[54] PROCESS FOR BLEACHING A MECHANICAL PULP WITH HYDROGEN PEROXIDE

[76] Inventors: Dominique Lachenal, 1, place de la Commune, 38130 Echirolles; Claude Bourne, 11, allée des Fresnes; Christian de Choudens, Les Tilleuls, both of 38610 Gieres, all of France

[21] Appl. No.: 39,794

[22] Filed: Apr. 16, 1987

Related U.S. Application Data

[63] Continuation of Ser. No. 745,007, Jun. 14, 1985, abandoned.

[30] Foreign Application Priority Data

Jun. 15, 1984 [FR] France ..... 84 09718

[51] Int. Cl.[4] ..... D21C 9/12; D21C 9/16

[52] U.S. Cl. ..... 162/24; 162/65; 162/71; 162/78

[58] Field of Search ..... 162/65, 71, 78, 24

[56] References Cited

U.S. PATENT DOCUMENTS

| | | | |
|---|---|---|---|
| 3,024,158 | 3/1962 | Grangaard et al. | 162/65 |
| 3,719,552 | 3/1973 | Farley et al. | 162/78 |
| 3,832,276 | 8/1974 | Roymoulik et al. | 162/65 |
| 4,029,543 | 6/1977 | Lindahl | 162/24 |
| 4,239,643 | 12/1980 | Kowalski | 162/80 |
| 4,372,812 | 2/1983 | Phillips et al. | 162/65 |
| 4,410,397 | 10/1983 | Kempf | 162/78 |
| 4,459,174 | 7/1984 | Papageorges et al. | 162/65 |
| 4,568,420 | 2/1986 | Nonni | 162/65 |
| 4,626,319 | 12/1986 | Krüger et al. | 162/65 |

FOREIGN PATENT DOCUMENTS

| | | | |
|---|---|---|---|
| 1959118 | 6/1970 | Fed. Rep. of Germany | 162/65 |
| 2040763 | 11/1971 | Fed. Rep. of Germany | 162/65 |
| 686197 | 9/1968 | South Africa . | |

OTHER PUBLICATIONS

Beeman et al., "Properties of Sodium Peroxide Bleached Mechanical Pulp and Its Applications in Paper Manufacture", Tappi Section, 6/15/44, pp. 33–36.

Andrews and Singh, The Bleaching of Pulp, Tappi, 3rd ed., pp. 214–220.

Sjostrom, Wood Chemistry Fundamentals and Applications, Academic Press, pp. 146–168 (1981).

Gierer, Chemical Aspects of Delignification, pp. II:1-2–II:17.

Gellerstedt; Chemical Aspects of Hydrogen Peroxide Bleaching, pp. II:120–II:124.

*Primary Examiner*—David L. Lacey
*Assistant Examiner*—V. Manoharan
*Attorney, Agent, or Firm*—Lee C. Robinson, Jr.

[57] ABSTRACT

Mechanical pulp is bleached by a treatment with hydrogen peroxide wherein prior to or simultaneously with said treatment the mechanical pulp is subject to an oxygen pressure.

18 Claims, 1 Drawing Sheet

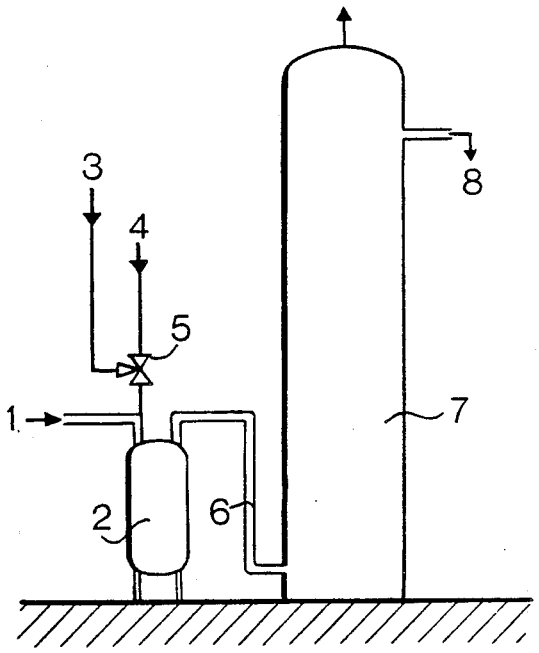
3
4
5
1
2
6
7
8

PROCESS FOR BLEACHING A MECHANICAL PULP WITH HYDROGEN PEROXIDE

This application is a continuation of application Ser. No. 745,007, filed June 14, 1985, now abandoned.

The invention relates to a process for bleaching a mechanical pulp with hydrogen peroxide.

The bleaching of a mechanial paper pulp comprises eliminating the coloured groups of the pulp by oxidation or a reduction of these groups without rendering soluble the constituents of the wood in the bleaching liquor. This operation is carried out industrially with hydrogen peroxide $H_2O_2$ (P) or sodium or zinc hydrosulphite.

The use of hydrogen peroxide (P) permits the attainment of higher levels of bleaching than those obtained with hydrosulphite. It is therefore generally used where the object is to prepare pulps having a whiteness of 80 (ISO standard). In this case, the bleaching is achieved either in a single stage with hydrogen peroxide or in two stages, the first stage being a treatment with hydrogen peroxide and the second a treatment with hydrosulphite. Under optimal conditions using hydrogen peroxide, the medium is rendered alkaline by the addition of caustic soda. In this medium, the hydrogen peroxide is rapidly decomposed into oxygen with transitional formation of species creating free radicals which are inoperative in the bleaching procedure. This decomposition is catalyzed by the cations of the transition metals present in the pulp. There is consequently a loss of hydrogen peroxide present in the medium in the form of anion $HOO^-$, and consequently a reduction in the efficiency of the bleaching. In practice, the alkaline solution of hydrogen peroxide is stabilized by the addition of sodium silicate, magnesium salt and often metallic cation sequestering agents. Notwithstanding these precautions, the decomposition of the peroxide is not completely eliminated and it is considered that about 10% of the quantity of peroxide is lost.

The use of oxygen as a bleaching agent of chemical pulps has also been proposed. In constrast to the bleaching of mechanical pulps, the bleaching of chemical pulps consists in dissolving the residual lignin (delignification) so as to obtain cellulosic pulps devoid of lignin. Therefore it no longer concerns effecting a moderate treatment on the coloured groups of the pulp but depolymerizing and dissolving the macromolecules carrying these coloured groups.

It has also been proposed to apply the oxygen as a cooking agent for certain annular plants. In this case, the oxygen serves to dissolve the lignin of the plant for the purpose of obtaining a chemical pulp.

On the other hand, oxygen is not a bleaching agent for mechanical pulps. Further, D. H. ANDREWS and R. P. SINGH mention in the work entitled "The bleaching of pulp", Editor TAPPI Press (1979), p. 215, that oxygen in an alkaline medium results in a yellowing of mechanical pulp, which is in conformity with what is known of the chemistry of lignin in the presence of oxygen.

It has been shown that, in the course of the treatment of plants or chemical pulps with oxygen, the dissolving of the lignin is accompanied by the formation of small quantities of hydrogen peroxide. Practically nothing is known of the participation of the hydrogen peroxide thus formed in the bleaching mechanism with the use of oxygen in respect of chemical pulps. No doubt it also has its own action in the bleaching of the chemical pulp treated in this way. This is the reason why it has been proposed in the processes for delignification with oxygen, whether it concerns the cooking of plants or the bleaching of chemical pulps, to introduce hydrogen peroxide in the liquor. The efficiency of the delignification is improved thereby. It is therefore clear from these works that hydrogen peroxide may reinforce the delignifying action of oxygen.

Contrary to the aforementioned teaching of the prior art, oxygen is capable of reinforcing the bleaching action of hydrogen peroxide in the bleaching of mechanical pulps whether the two reagents are used one after the other or simultaneously.

The process of bleaching mechanical pulp with hydrogen peroxide according to the invention is characterized in that the mechanical pulp is subjected to an oxygen pressure prior to or simultaneously with said peroxide treatment.

Hereinafter, "oxygen pressure" is intended to mean both the use of oxygen at atmospheric pressure and under super atmospheric pressure, the latter being capable of reaching a few bars. The action of oxygen can therefore be exerted either with atmospheric oxygen, which then acts on the pulp in particular by a sweeping or licking, or with oxygen under super atmospheric pressure, for example that exerted under the effect of the height of a column of pulp in a rising bleaching tower.

It is quite unexpected to find that the oxygen can be used as a bleaching agent since, as has been explained in the preamble, the oxygen used alone in an alkaline medium has no bleaching action on a mechanical pulp.

In a first embodiment of the invention, the bleaching of the mechanical pulp with hydrogen peroxide is carried out under the conventional industrial conditions, i.e., in an alkaline medium in the presence of stabilizing agents which may be sodium silicate, magnesium sulfate, and the sequestering agents usually employed such as the sodium slats of diethylenetriaminopentacetic acid at a temperature lower than 100° C. under an oxygen atmosphere. In this manner of proceeding, the mechanical pulp containing the bleaching agents may be mixed with gaseous oxygen in a suitable mixer before being sent to the bleaching tower which is preferably a rising tower.

By way of a modification, the pulp containing the bleaching products is sent into a tower containing oxygen, or into any other type of reactor containing oxygen, and where the bleaching of the pulp will be carried out or continued. This embodiment therefore concerns a process which will be termed P/O (sequence: hydrogen peroxide/oxygen) according to the usual acknowledged international code.

In a second embodiment of the invention, the mechanical pulp rendered alkaline with the addition of soda or silicate, is mixed with oxygen and then left as such with its oxygen pressure at a temperature lower than 100° C. for the required period, which should not exceed 4 hours. This operation is carried out in a suitable reactor which may be a tower. The reagents of the bleaching proper, in particular hydrogen peroxide, are then added. Then the pulp is placed under the conventional conditions for bleaching with hydrogen peroxide. This process will therefore have the reference O P according to the acknowledged code.

Other combinations may be envisaged, for example the combination O P/O in which the second stage of treatment is also carried out under an oxygen atmosphere.

It will be understood that it may also be of utility in the process according to the invention to include washing and/or pressing stages and to effect partial recyclings of effluents containing residual peroxide or products of oxidation of pulp by the oxygen or the hydrogen peroxide.

Advantageously, in practice:

the oxygen is used either at atmospheric pressure or under super atmospheric pressure;

the oxygen pressure is lower than 5 bars and is in particular between 2 and 3 bars so that it is possible to use the usual equipment; the process does not therefore involve an expensive outlay;

when the oxygen pressure is applied, the pH of the pulp is between 9 and 12 and preferably between 10 and 11, i.e. between the conventionally applied figures for the bleaching of mechanical pulps;

likewise, when this oxygen pressure is applied, the temperature is between 40° and 100° C., and preferably between 50° and 60° C.; indeed, if the temperature exceeds 100° C., the oxygen is liable to delignify the pulp;

the consistency of the pulp is between 8 and 30% and preferably between 10 and 20%;

finally, the hydrogen peroxide bleaching liquor is a conventional liquor comprising in addition to the hydrogen peroxide, sodium silicate, and other sequestering agents usually employed.

The manner in which the invention may be carried out and the resulting advantage will be more apparent from the following examples which are given by way of non-limiting examples.

In these examples, except for example 4, for each example the sample of the pulp is subjected to two tests, namely:

the first test (tests 1, 3 and 5) concerns a conventional treatment with peroxide (P), then the second test concerns a treatment accordment to the invention (2, 4, 6) that is (P/O or OP).

In all these examples, there is employed a mechanical pulp of a stack of spruce having an unbleached whiteness of 56% measured according to ISO standard on the Elrepho apparatus.

EXAMPLE 1

In this first test (test no. 1), the pulp is bleached in a single stage with a hydrogen peroxide alkaline liquor under the following conditions (the reaction rate being expressed as weight of pure product relative to the weight of pulp measured in the dry condition):

| | |
|---|---|
| Temperature | 55° C. |
| Consistency | 15% |
| Duration | 240 minutes |
| Amount of $H_2O_2$ | 2% |
| Amount of NaOH | 1.5% |
| Amount of sodium silicate at 41° Be | 3.5% |
| Amount of magnesium sulfate $MgSO_4$, $7H_2O$ | 0.5% |
| DTPA (at 40%) | 0.25% |

For this purpose, the pulp and the alkaline liquor are introduced into an enclosure at the treating temperature. After this treatment, the pulp is washed. Its degree of whiteness is 72.2%. The consumption of hydrogen peroxide is 1.75%.

This test 1 corresponds to the sequence P.

In a second test (test no. 2) the same unbleached mechanical pulp is treated with oxygen under the following conditions:

| | |
|---|---|
| Consistency | 15% |
| Temperature | 55° C. |
| Duration | 120 minutes |
| Amount of soda | 1% |
| Oxygen pressure | 2 bars |

After this treatment with oxygen (O), the pulp is washed and then treated with the liquor containing hydrogen peroxide (P) under the same conditions as in test 1. The whiteness obtained is 73.2%. This represents a gain of 1% relative to the test no. 1. The consumption of hydrogen peroxide is 1.5%, namely 0.25% lower than that of the first test.

This test no. 2 therefore corresponds to the sequence OP.

EXAMPLE 2

The same pulp as before is treated with hydrogen peroxide alkaline liquor of Example 1 in a metal autoclave immersed in the thermofluid of a rotary laboratory reactor (test no. 3). The treating conditions are the same as those of test no. 1. After this sequence P, the whiteness obtained is 70.6%, probably due to an insufficient mixing.

The same test is resumed by subjecting the pulp to an oxygen pressure of 3 bars throughout the treatment with the hydrogen peroxide (test no. 4). The whiteness obtained after this treatment P/O is 72.3%, namely a gain of 1.7% with respect to test no. 3 which no oxygen was introduced.

EXAMPLE 3

The same mechanical spruce pulp as before is treated this time in a horizontal reactor internally stirred by means of blades fixed to a horizontal rotary shaft (test no. 5) with the same hydrogen peroxide alkaline liquor under the conditions of test no. 1. After treatment (P) the whiteness is distinctly improved since it reaches 74%.

The same test is resumed by subjecting the pulp to an oxygen pressure of 2 bars throughout the treatment with hydrogen peroxide (text no. 6). After this treatment P/O, the whiteness obtained is 75.2%, namely a gain of 1.2% with respect to test no. 5 which does not include oxygen.

EXAMPLE 4

The same unbleached mechanical spruce pulp, i.e. having a whiteness of 56%, is treated with an alkaline liquor under an oxygen pressure of 3 bars. This liquor does not contain hydrogen peroxide. The treatment conditions are identical to those of test no. 4, i.e. with the use of a metal autoclave. The pulp is therefore subjected to an oxygen pressure of 3 bars throughout the treatment. After this treatment O, the whiteness obtained is 54.5% as against 72.3% according to the invention.

The results clearly show that, in the process according to the invention, the oxygen is not in itself a bleaching agent for the mechanical pulp (see Example 4) but that on the other hand, the combination of the oxygen with the hydrogen peroxide acting either simultaneously or in a prior manner, reinforces the bleaching power of the hydrogen peroxide.

Consequently, the process according to the invention may be successfully employed for the bleaching of mechanical pulps.

BRIEF DESCRIPTION OF THE DRAWING

There is treated in accordance with the process of the invention the same spruce mechanical pulp in a rising tower diagrammatically shown in the accompanying single figure in current use for bleaching in the papermaking industry.

In this figure, the reference 1 designates the pulp which is sent to the mixer 2 where it receives simultaneously oxygen 3 and hydrogen peroxide 4 supplied to the mixer 2 through a three-way valve 5.

The mixture of pulp produced is sent through the pipe 6 to the rising tower 7 where this mixture of pulp and reagents stays for the period of time required for the reaction. The bleached pulp is recovered at 8.

The height of the column of pulp in the tower 7 insures a sufficient oxygen pressure.

What is claimed is:

1. A process for bleaching a mechanical pulp comprising: subjecting the mechanical pulp to oxygen, and treating the pulp with hydrogen peroxide, the hydrogen peroxide bleaching the mechanical pulp, and the oxygen reinforcing the bleaching power of the hydrogen peroxide.

2. A process according to claim 1, comprising subjecting the mechanical pulp to said oxygen simultaneously with said hydrogen peroxide treatment.

3. A process according to claim 1, comprising subjecting the mechanical pulp to oxygen prior to said treatment with hydrogen peroxide.

4. A process according to claim 1, comprising effecting said treatment with the oxygen at atmospheric pressure.

5. A process according to claim 1, wherein said oxygen is gaseous oxygen under super atmospheric pressure.

6. A process according to claim 1, wherein the oxygen pressure is lower than 5 bars.

7. A process according to claim 6, wherein the oxygen pressure is between 2 and 3 bars.

8. A process according to claim 1, wherein, the pH of the pulp is between 9 and 12.

9. A process according to claim 8 wherein said pH is between 10 and 11.

10. A process according to claim 1 wherein the temperature of the pulp is between 40° and 100° C.

11. A process according to claim 10, wherein said temperature is between 50° and 70° C.

12. A process according to claim 1, wherein the consistency of the treated mechanical pulp is between 8 and 30%.

13. A process according to claim 12, wherein the consistency of the treated mechanical pulp is between 10 and 20%.

14. A process according to claim 1 wherein the pulp is treated with bleaching liquor containing, in addition to the hydrogen peroxide, soda, sodium silicate, and sequestering agents.

15. A process for bleaching mechanical pulp comprising, in combination:

introducing mechanical pulp into an enclosure; directing oxygen into the enclosure to expose the mechanical pulp to an oxygen atmosphere; and while the pulp is exposed to said oxygen atmosphere, treating the mechanical pulp with an alkaline solution of hydrogen peroxide stabilized with a stabilizing agent;

the hydrogen peroxide bleaching the mechanical pulp, and the oxygen reinforcing the bleaching power of the hydrogen peroxide.

16. A process according to claim 15, wherein the stabilizing agent is sodium silicate.

17. A process according to claim 15, wherein the stabilizing agent is a magnesium salt.

18. A process according to claim 15, wherein the stabilizing agent is a metallic cation sequestering agent.

* * * * *

UNITED STATES PATENT AND TRADEMARK OFFICE

CERTIFICATE OF CORRECTION

PATENT NO. : 4,756,798

DATED : July 12, 1988

INVENTOR(S) : Lachenal et al

It is certified that error appears in the above-indentified patent and that said Letters Patent is hereby corrected as shown below:

On the title page, after item [76] insert the following:

—[73] Assignee: L'Air Liquide, Societe Anonyme Pour L'Etude et L'Exploitation des Procedes Georges Claude, Pairs, France—.

Signed and Sealed this

Ninth Day of May, 1995

Bruce Lehman

*Attest:*

BRUCE LEHMAN

*Attesting Officer*

*Commissioner of Patents and Trademarks*